United States Patent [19]

Studer et al.

[11] Patent Number: 4,691,726

[45] **Date of Patent: * Sep. 8, 1987**

[54] METHOD AND APPARATUS FOR VALVE ASSEMBLY FOR A HOT WATER TANK

[76] Inventors: Robert L. Studer, 6116 NE. 87th St., Redmond, Wash. 98052; William E. Schourup, 23234 NE. 54th, Redmond, Wash. 98053

[ * ] Notice: The portion of the term of this patent subsequent to Apr. 2, 2002 has been disclaimed.

[21] Appl. No.: 640,687

[22] Filed: Aug. 13, 1984

Related U.S. Application Data

[63] Continuation-in-part of Ser. No. 528,721, Aug. 31, 1983, Pat. No. 4,508,130.

[51] Int. Cl.[4] ..... F16K 43/00

[52] U.S. Cl. ..... 137/15; 137/318; 138/97; 138/99; 251/267; 285/248; 285/249; 285/343; 285/354

[58] Field of Search ..... 137/15, 315, 318; 138/89, 90, 94, 94.3, 97, 98, 99; 251/266, 267, 327; 285/31, 32, 341, 342, 343, 382.7, 248, 249, 354

[56] References Cited

U.S. PATENT DOCUMENTS

| | | | |
|---|---|---|---|
| 104,568 | 6/1870 | Flower | 251/266 |
| 190,965 | 5/1877 | Foster, Jr. | 285/341 |
| 848,009 | 3/1907 | Castle | 251/266 |
| 871,607 | 11/1907 | Montgomery | 285/343 |
| 1,186,812 | 6/1916 | McFerran | 285/341 |
| 1,307,540 | 6/1919 | Dohner | 285/343 |
| 1,462,834 | 7/1923 | Stenwall | 251/266 |
| 1,896,371 | 2/1933 | Quarnstrom | 285/341 |
| 1,927,451 | 9/1933 | Dobrick | 285/341 |
| 2,069,177 | 1/1937 | Craver | 285/341 |
| 2,139,413 | 12/1938 | Kreidel | 285/357 |
| 2,344,698 | 3/1944 | Howe | 285/341 |
| 2,405,489 | 8/1946 | Brock | 285/343 |
| 2,455,667 | 12/1948 | Franck | 285/3 |
| 2,460,621 | 2/1949 | Courtot | 285/343 |
| 2,536,552 | 1/1951 | Katz | 285/453 |
| 2,795,437 | 6/1957 | Mueller | 285/354 |
| 2,984,129 | 5/1961 | Allen | 137/318 |
| 3,687,166 | 8/1972 | Herrin | 137/318 |
| 3,972,547 | 8/1976 | Itoya | 285/382.7 |
| 4,022,497 | 5/1977 | Kotsakis | 285/341 |

*Primary Examiner*—George L. Walton
*Attorney, Agent, or Firm*—Hughes & Cassidy

[57] ABSTRACT

A method of replacing an inlet valve for a hot water tank, comprising removing the existing valve and inserting a new valve particularly adapted for use in the present invention. The new valve is connected to the pipe end portion of the inlet pipe by means of a compression nut and a ferrule, with the compression nut attaching to exterior threads on a first connecting portion of the valve. Then the flex tube connecting member is interconnected with the exterior threads of a second pipe connecting portion. The valve itself is a gate valve with a full flow through passageway, and the two exteriorly threaded connecting portions are to be connected to the compression nut and the flex tube connecting nut, respectively.

20 Claims, 5 Drawing Figures

METHOD AND APPARATUS FOR VALVE ASSEMBLY FOR A HOT WATER TANK

CROSS-REFERENCE TO RELATED APPLICATIONS

This is a continuation-in-part of U.S. patent application Ser. No. 528,721, filed Aug. 31, 1983, by Robert L. Studer and William E. Schourup, now U.S. Pat. No. 4,508,130.

BACKGROUND OF THE INVENTION

1. Field of the Invention

The present invention relates to a method of installing a valve in an existing plumbing system, and to a valve and valve assembly particularly adapted for use in such method.

2. Background Art

For many years, the conventional method of providing a water distribution system for a building is to provide a network of pipes (made of copper or some other suitable material) which extend from a main inlet to various locations in the home or other building structure, with a valve being provided at each discharge location. There is generally a main shut off valve at an upstream location, this valve being positioned so that it can shut off water to the entire network in the building. Also, at each discharge location, there is quite often provided an additional local shutoff valve so that any single discharge valve can be isolated from the rest of the water distribution network. For example, at the location of a valve for a wash basin, there is quite often a local shutoff valve with a flexible fitting which leads from the end of the pipe to the valve.

In addition, there are sometimes provided one or more shutoff valves at intermediate locations in the distribution network, with the flow through this shutoff valve servicing more than one outlet. A typical instance of such a shutoff valve is one which is positioned at the cold water inlet to a hot water heater. Typically, this shutoff valve has two connecting portions which are adapted to interfit with pipes in a soldered connection. One such soldered connection would be made to a pipe upstream of the valve, and the other soldered connection would be made to a short length of pipe, which in turn is soldered to a threaded fitting having exterior threads. This threaded fitting is in turn connected in threaded engagement with an interiorly threaded nut of a flex tube that would in turn lead to the cold water inlet of the hot water tank.

During the initial installation of such a valve assembly of a cold water inlet of a hot water tank, the soldered connections can be made quite easily. However, in the event that a leak develops in the valve and it is desired to replace the valve, the following procedure is followed. The valve assembly is separated from the nut of the flex tube connection simply by unthreading the nut. Then this valve assembly is severed from the upstream pipe in a suitable manner (e.g. by sawing or cutting the pipe immediately upstream of the valve itself). Then a replacement valve is connected to the upstream pipe by making a soldered connection. In the cramped quarters of an existing hot water tank installation, the manipulation of the torch and the making of such a solder connection can be quite difficult. Also, there is made a couple of other solder connections, namely the solder connection with the short length of pipe and also to the fitting that is to engage the nut of the flex tube connection.

To the best knowledge of the applicants, this same procedure of replacing a valve in an existing plumbing system has remained the same for many decades. It is believed that a number of factors have influenced the prior art relative to the present invention. One factor is that for many decades most plumbers have first gone through an apprenticeship training and have learned to accept certain traditional practices in the plumbing industry. Further, there are code regulations which have been in effect for a number of years, and these dictate certain practices, use of certain plumbing components, etc. In accordance with what might be called long standing "traditions" in the plumbing industry, manufacturers have produced their plumbing supplies to conform to these traditional practices. Possibly there has even developed what might be called a "communication gap" between the manufacturers of plumbing supplies and those who operate in the field installing plumbing components and fixtures, and that neither knows enough about what could be done by the other to have a broad enough perspective to make certain innovations. The present state of the art is such that there is, at least in terms of the steps the plumber has to take, somewhat time consuming and complex pattern in replacing a valve. This same pattern is repeated literally thousands of times a year, and its day to day repetition has been in turn repeated year after year. The same problem exists in modifying an existing plumbing installation where possibly a new component is to be added, such as a new water heater to be added as part of a remodelling program.

Accordingly, it is an object of the present invention to provide an improved method of providing a valve in an existing plumbing system either as a replacement valve or one to be added to the system, and also to provide a valve and valve assembly particularly adapted for the same.

SUMMARY OF THE INVENTION

The method of the present invention is for installing a valve in a water distribution network of an existing plumbing system, where there is an existing distribution pipe and an existing main shutoff valve. The distribution pipe has an upstream end and a downstream outlet end, and also has an outside surface of a predetermined outside diameter, and an inside surface defining a passageway having a predetermined passageway diameter and passageway cross-sectional area. The existing main shutoff valve is located upstream of the upstream end of the distribution pipe.

The method comprises determining an installation location where the valve is to be installed in the plumbing system. The existing shutoff valve is then operated to stop flow of water to the installation location.

Then the distribution pipe is provided at the installation location with an open end pipe portion which is substantially undistorted and provides a substantially uninterrupted through passageway portion. Then there is provided a valve assembly comprising a valve, a compression nut, and an annular compression seal.

The valve comprises a main body portion defining a central through passageway section having a cross-sectional area at least as great as that of the pipe passageway. There is a valve closure member having a first position closing said central through passageway section and a second position where said central through passageway section is substantially unobstructed. The valve has a first connecting portion defining a substantially unobstructed through passageway and having an exterior threaded surface portion with threads arranged to receive a compression fitting. The valve also has a second connecting portion defining a substantially unobstructed through passageway and having an exterior threaded surface portion with threads adapted to receive a conventional plumbing connection member with interior threads.

The compression nut of the valve assembly has an annular integral structure, with an inner threaded surface to engage the threaded surface portion of the first connecting portion, and having a through opening to receive the pipe end portion. There is also an annular compression seal member adapted to be positioned adjacent said pipe end portion in sealing engagement with the first connecting portion and said pipe end portion.

Then the valve is inserted at the selected installation location, with the compression nut and the seal member being placed adjacent the pipe end portion, and with the first connecting portion being in connecting relationship with said pipe end portion. The nut is threaded onto the first connecting portion to bring the seal member in sealing relationship with the pipe end portion.

Then a conventional interiorly threaded connecting member is threaded onto the second connecting portion.

After the installation of the valve is completed, the existing shutoff valve is then opened.

In the preferred form, the first connecting portion has an interior surface configured to engage an exterior surface of the pipe end portion, and the pipe end portion is inserted into the first connecting portion of the valve. Where there is an existing valve at the installation location, the pipe end portion is provided by cutting said existing valve from the distribution pipe. Where the existing valve is also connected to a connecting nut of a flex tube member, the existing valve is unthreaded from the connecting nut. Then the second connecting portion of the valve is connected to the nut of the flex tube member.

In a circumstance where the plumbing system comprises a water heater, a flex tube member connected to an inlet of the water heater, and an existing valve assembly, comprising an existing valve having a solder connection to an existing inlet pipe, the method further comprises the following steps. The flex tube connecting member is unthreaded from the valve assembly. Then the inlet pipe is cut so as to separate the existing valve from the system. Then the valve is installed in place of the existing valve by connecting the first connecting portion of the pipe end portion, and then threading a connecting nut of the flex tube member onto the second connecting portion.

The valve assembly made according to the method of the present invention provides a substantially unrestricted flow passageway from the pipe end portion through the central through passageway of the valve. Desirably, the first connecting portion has an annular shoulder to engage an edge portion of the pipe end portion and thus locate the valve relative to the pipe end portion.

In the preferred form, the closure member is a gate member, with the valve being arranged so that the gate member is moved totally out of alignment with the pipe end portion in its open position.

Other features of the present invention will become apparent from the following detailed description.

DESCRIPTION OF THE PREFERRED EMBODIMENT

Figure 1:
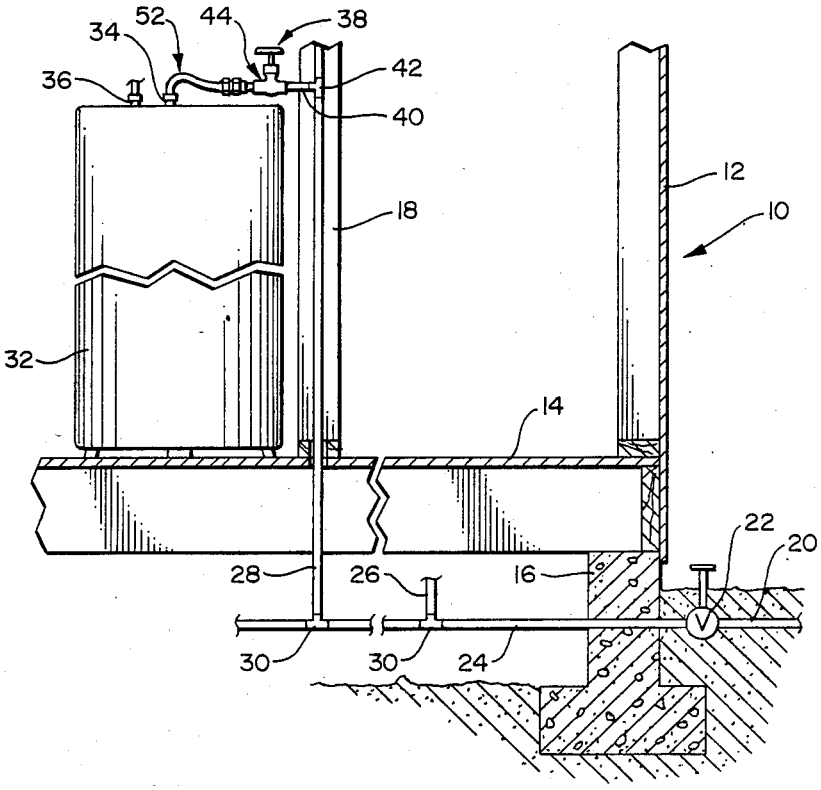
FIG. 1 is a side elevational view, partly in section, illustrating somewhat schematically a portion of a conventional water distribution network, such as those commonly existing in homes or other building structures.

In FIG. 1, there is a simplified showing of a typical water distribution system for a home or other building structure, for which the present invention is particularly adapted. As shown herein, the building structure 10 has an outside wall 12, a floor 14, footings 16, and an interior wall 18. The water distribution system has a main inlet pipe 20 which is generally placed underground to prevent freezing. At some upstream location there is a main shutoff valve indicated somewhat schematically at 22 at a location immediately outside the building 10.

From the shutoff valve 22, there extends into the building structure 10 (as shown herein in the crawl space below the building structure 10), a main pipe 24, from which extend several distribution pipes, two of which are shown at 26 and 28. These pipes 26 and 28, as well as others in the water distribution system, are joined in a network by couplings, such as the two "T" couplings illustrated at 30. The ends of the pipes (such as shown at 24, 26 and 28) are inserted into the connecting portions provided by the fittings 30, to form a water tight connection. Quite commonly the pipes 24, 26 and 28 are bonded to the fittings 30 by use of solder applied to the connecting surfaces under heat. This method of making water tight plumbing connections is commonly called "sweating".

One of the typical components of a water distribution system is a hot water heater, which generally comprises a hot water tank 32 having a cold water inlet 34 and a hot water outlet 36. The inlet 34 is typically connected to the water distribution network through a valve assembly, and such a valve assembly is shown somewhat schematically at 38.

Generally, to utilize the space of the building structure more effectively, the hot water tank 32 is placed in a more remote or less used section of the home or other building structure, generally adjacent a wall, such as that at 18. Typically, there is a cold water inlet line 40 which, as shown herein, leads from a T-union 42 that in turn connects to one of the distribution pipes 28 located within the structure of the wall 18. Commonly, there is a valve 44 having a main valve portion 46 and two oppositely directed connecting portions 48 and 50, each of which is an unthreaded cylindrical member that is sized to fit around the end of the pipe to which it is to be connected. One connecting portion 48 of the valve 44 is connected to the water inlet line 40, and this is commonly done by a typical soldered or "sweated" connection.

The connection to the inlet 34 of the tank 32 is commonly made by means of a flex tubing, such as shown at 52. One of the reasons for this is that the plumbing network is commonly installed in the building structure 10 at an earlier time during the construction. For example, in a typical residential structure, the house will be "framed", with the framed wall structure being a number of interconnected two-by-four pieces of wood. Normally, substantially the entire plumbing system for the house, including the various pipes, such as shown at 24–28, fittings 30, and various valves, such as shown at 44, are all interconnected by soldered or "sweated" connections. Subsequent to the installation of the main plumbing system, the drywall or other wall cover will be applied to the studs that make up the framework of the wall structure. After the drywall or other wall cover is installed, then items such as the water tank 32 will be put into place.

Since a water tank 32 is generally a bulky structure, and since the precise location of the water tank 32 may vary to some degree depending upon convenience or other specific requirements, it is quite common to make the final connection between the valve 44 and the water inlet 34 through a flexible connection, such as the flex tubing 52, to allow for such variations in the precise location of the tank 32.

A typical flex tube connection 52 comprises the main tube portion 54 of a foot or more in length, and two end fittings 56 and 58. These fittings 56 and 58 are formed with interior threads to connect to a fitting having exterior threads, with one such exteriorly threaded fitting being the cold water inlet 34 for the tank 32, and the other being shown as a fitting 60 that connects to the valve 44. This fitting 60 comprises an exteriorly threaded connecting portion 62 adapted to mate with the flex tube connecting portion 56, a middle nut portion 64 having flat sides to be gripped by a wrench or pliers, and a second connecting portion 66 defining a socket to receive a pipe section 68. The pipe section 68 is typically a short length of copper tubing (or tubing made of some other metal), extending between the connecting portion 50 of the valve 44 and the connecting portion 66 of the connecting member 60.

At this point, let us review the overall makeup of the prior art valve assembly 38 that connect the cold water inlet pipe 40 of the plumbing network with the cold water inlet 34 of the tank 32. First, there is the valve 44, the short length of connecting pipe 68, the adaptor 60, and finally the flex tube connection 52. Further, there are three soldered connections, and two threaded connections. More specifically, there are the following soldered connections:

(a) The connection between the cold water inlet 40 and the valve connecting portion 48;
(b) The connection between the valve connecting portion 50 and the short tube length 68; and
(c) The connection between the connecting portion 66 of the adapter 60 and the short pipe length 68.

The two threaded connections are those that connect the flexible tube connector 52. Specifically, there is the connection between the flexed tube connecting portion 56 and the exteriorly threaded portion 62 of the adaptor 60. Also, there is the connection of the flex tube connecting portion 58 with the cold water inlet 34 of the tank 32.

During the initial construction of the building structure 10, it is quite possible for the above valve assembly 38 to be installed with reasonable efficiency. During the initial installation of the entire water distribution network, the three connections between the inlet pipe 40, the valve 44, the short pipe connection 68 and the adaptor 60 can be made while the plumber is working on the entire installation, and has the equipment available to make the soldered connections. Further, with the building only being partially constructed, and with only the stud framing of the walls being erected, there is adequate room to maneuver and make the soldered connections. Accordingly, after the drywall or other wall cover has been installed, and the tank 32 moved into place, the connection with the flex tubing connector 52 can easily be made by making the two threaded connections with the flex tube connecting portions 56 and 58.

However, let us examine the situation where it becomes necessary to repair a leak in the valve assembly 38, or possibly a situation where the water supply network is already in place and it is desired to install the tank 32 of the water heater. (The latter situation could occur, for example, during a remodeling operation where a hot water tank 32 is installed to increase the rapacity of the system.) The common prior art method of doing this would be to reconstruct the assembly 38 as shown above. Thus, if a new valve assembly is being installed, it is necessary to employ the expertise of a person (presumably a qualified plumber) who would make the three soldered connections between the inlet pipe 40, the valve 44, the short pipe connection 68 and the adapter 66. If the wall structure 18 is in place, with dry wall or other wall covering applied to the basic wall structure, then it becomes necessary to operate the torch and other implements utilized in making the soldering connection in somewhat cramped quarters.

Under circumstances where it is necessary to make a repair to the valve assembly 38, there are also difficulties. If one or more of the components are to be replaced, this would presumably entail the removal of one of the components (e.g. possibly a defective valve 44), or possibly remaking or repairing the soldered connections. This in turn would entail a "sweating" or soldering operation under circumstances where it is less than totally desirable to perform such an operation.

Figure 3:
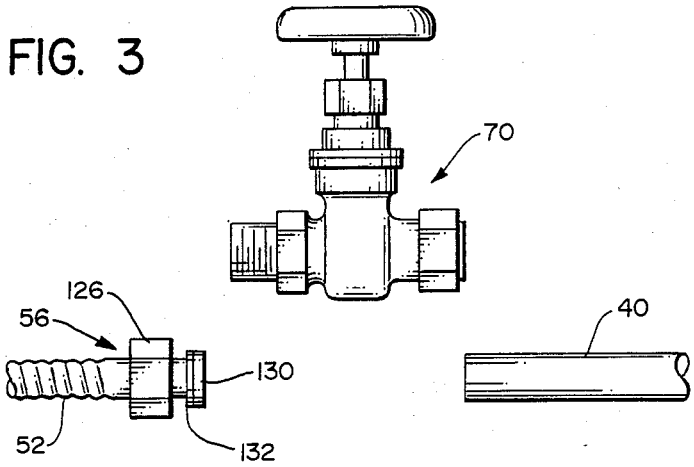
FIG. 3 is a side elevational view illustrating the valve assembly of the present invention in its preinstalled position, and ready for installation.
Figure 4:
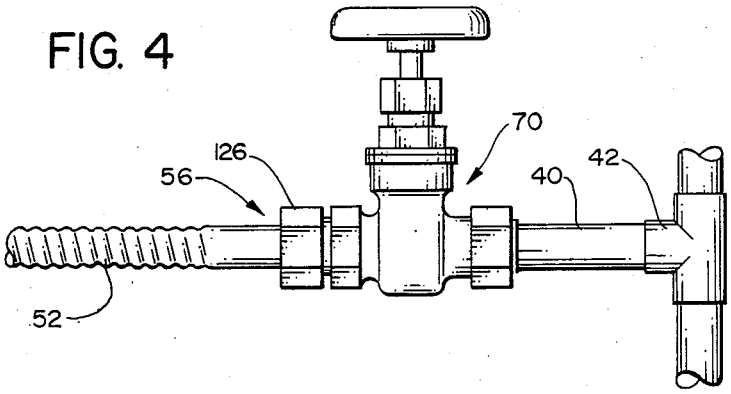
FIG. 4 is a view similar to FIG. 3, but showing the valve assembly in its installed position.
Figure 5:
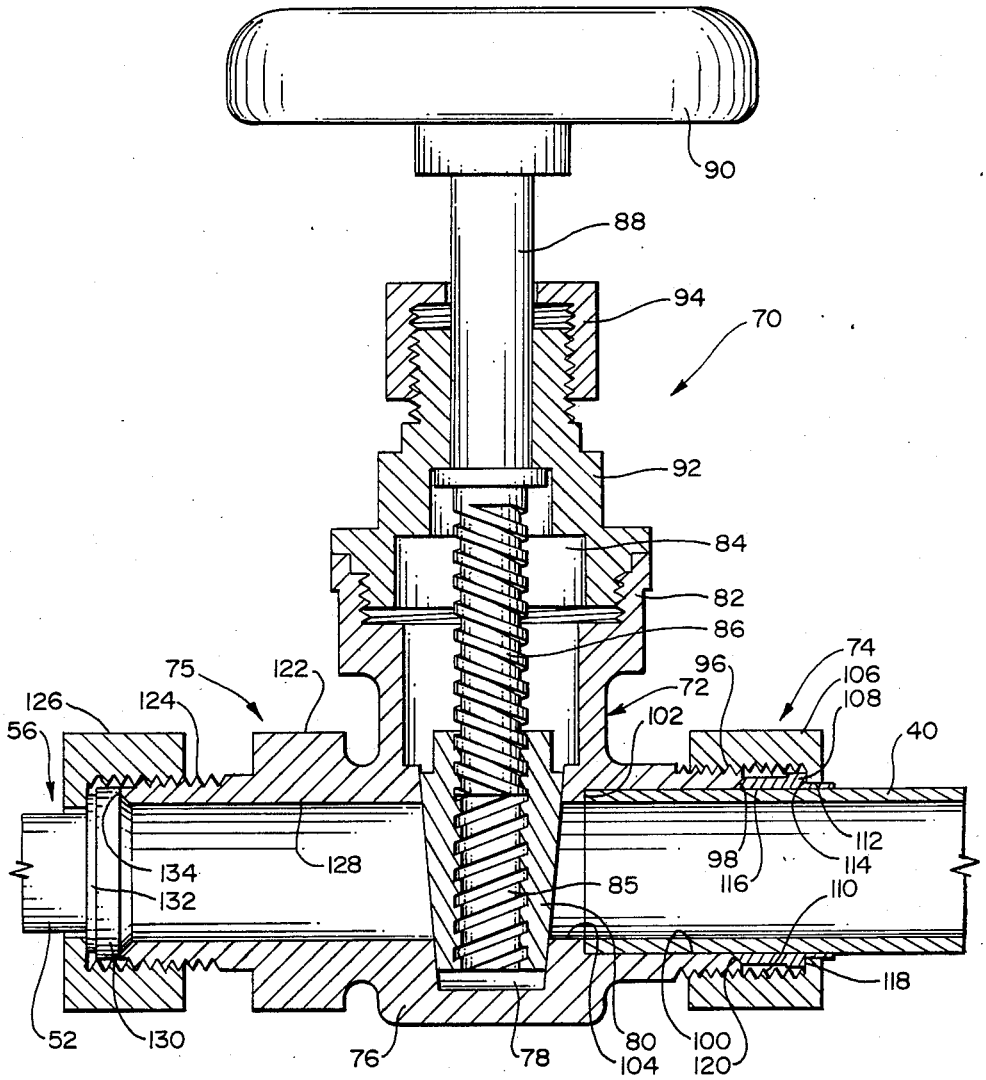
FIG. 5 is a sectional view of the valve assembly, drawn to an enlarged scale, with the section being taken on a plane coinciding with the lengthwise axis of the water pipe and the center axis of the valve.

This prior art system has, to the best knowledge of the applicants, been at least in the United States the common (if not universal) method of initially installing that portion of a water distribution system, and also the method of repairing the same. There have been standard practices which have been used in the plumbing industry for many years, and many of these have been followed without deviation. One reason for this is that most skilled plumbers have previously gone through an apprentice training program and have learned to accept certain traditional practices in the plumbing industry. Further, there are code reulations which have been in effect for a number of years, and these dictate certain practices. It is from this background of prior art that the present invention was conceived to provide a simplified and more convenient system of installing a valve assembly under these circumstances, while fully meeting all of the performance requirements of the plumbing industry. Reference is now made to FIGS. 3–5 to describe the present invention.

In FIG. 5, the valve assembly 70 of the present invention is shown in more detail. This valve assembly 70 can be considered as comprising a central operating portion 72 and two connecting portions 74 and 75 positioned on opposite sides of the central operating portion 72.

The central operating portion 72 is, in its present configuration, of a conventional configuration, and comprises a housing 76 defining a generally circular recess 78 to receive a generally disc-shaped closure member 80 which is formed as a conventional gate valve closure member. The recess 78 and closure member 80 may be tapered outwardly to a moderate extent in an upward direction to insure a snug fit of the closure member 80 in the recess 78.

The housing 76 has an upward annular extension 82 which has an open interior 84 to receive the closure member 80 when it is in its upper open position, as shown in FIG. 3. The closure member 80 is interiorally threaded at 85 to receive the lower threaded end 86 of a stem 88 which extends upwardly to join to an operating handle 90. To close the annular extension 82 and receive the stem 88, there is an upper housing member 92 which threadedly engages the main housing member 76 and has a circular through opening to snuggly receive the stem 88. A closure cap 94 is threaded onto the top end of the upper housing member 92, and this also has an opening to receive the stem 88.

The components of the central operating portion 72 of the valve 70 are, as shown herein, of more or less conventional configuration. By rotating the handle 90, the closure member 80 can be moved downwardly to completely occupy the recess 78 and thus totally stop flow through the valve 70. By rotating the operating handle in the opposite direction, the closure member 80 can be moved totally out of the recess 78 and leave an unobstructed through passageway.

To describe the valve connecting portion 74, the end of the connecting portion 74 which is further away from the central valve portion 72 will be considered as being at a forward location, while that portion of the connecting portion 74 which is closer to the valve operating portion 72 will be considered as being at a rearward location. The term "outside" will denote a distance further from the center axis of the connecting portion 74, while the term "inside" will denote a location closer to the center axis.

The forward outer surface 96 of the connecting portion 74 is threaded and the extreme forward end has a rearwardly and inwardly tapering surface 98 of a general frusto-conical configuration. The inner surface 100 which is located immediately rearwardly of the tapering surface 98 is cylindrical and has a diameter just slightly larger than the outside diameter of the water-pipe 40 to which it is to be connected. At the rear end of the surface 100 there is an annular shoulder 102, having a width dimension approximately the same as the thickness of the pipe 40. Extending further rearwardly from the stop shoulder 102 is an inside surface 104 which is stepped inwardly from the surface 100. This cylindrical surface 104 has a diameter the same as the inside diameter of the pipe 40 and provides a passageway which is totally unobstructed when the closure member 50 is in its fully open position.

To secure a pipe section to a connecting portion 74 of the valve 70, there is provided for the connecting portion 74 a compression nut 106 and a compression ferrule or sealing member 108. The nut 106 and the ferrule 108 are, as shown herein, of conventional configuration.

The nut 106 is made as an integral piece and has interior threads 110 which engage the threaded outer surface 96 of the connecting portion 74. At its forward end, the nut 106 is formed with a cylindrical through opening 112 just slightly larger than the outside diameter of the pipe 40, and rearwardly of this opening, the nut 106 has an annular shoulder 114 which faces rearwardly.

The ferrule 108 is made as an integral piece and has a generally annular configuration. It is provided with an inwardly facing cylindrical surface 116 which fits snuggly against the outside surface of the pipe 40. In addition, the ferrule 108 has a forward and a rear surface 118 and 120, respectively. The rear surface 120 slopes inwardly in a rearward direction to engage the surface 98. The forward surface 118 is positioned to engage the shoulder 114 of the nut 106.

The other connecting portion 75 comprises a rear portion 122 (the term "rear" denoting proximity to the central portion 72) that has its outer surface formed with six flat surfaces of a hexagonal configuration to facilitate gripping with a wrench or pliers. The connecting portion 75 has its forward end 124 formed with threads to receive a compression nut 126.

The interior surface 128 of the connecting portion 75 has a cylindrical configuration with a diameter the same as the interior diameter of the pipe 40 to which the other connecting portion 74 is joined. Thus, the valve assembly 70, with the closure element 80 in its open position, provides a substantially unobstructed flow passage from the pipe 40 through the valve assembly 70.

In the present invention, the nut 126 is made as part of the overall connecting portion 56 of the flex tube 52. There is a washer 130 that fits between an annular flange 132 attached to the flex tube 54 and a forwardly facing annular edge portion 134 of the connecting portion 75. Thus, it is readily apparent that the flex tube connecting portion 56 can be connected to the connecting portion 75 of the valve assembly 70 by threading the nut 126 onto the forward threaded portion 124, with the washer 130 being compressed between the flange 132 and the surface 134 to provide a proper seal.

Figure 2:
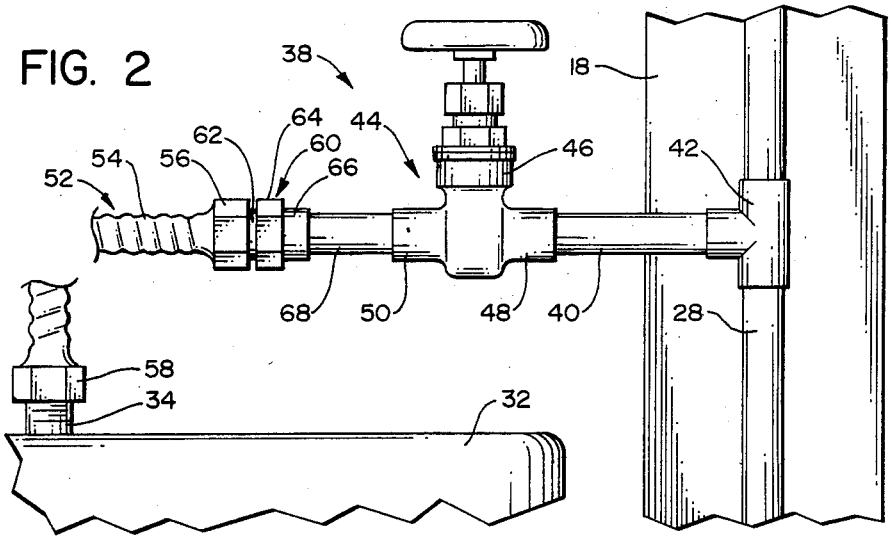
FIG. 2 is a side elevational view of a conventional prior art valve assembly, drawn to an enlarged scale relative to FIG. 1, for the cold water inlet of a hot water tank that is part of a water distribution system of FIG. 1.

To describe the operation of the present invention, let us assume that there is a completed building with an existing plumbing network, such as shown in FIGS. 1 and 2, and let it further be assumed that the valve 44 has become defective and must be replaced. The first step is to move the main shutoff valve 22 to its closed position, and then open a tap in the network that is in the same flow system as the water tank 32 (i.e. a tap on a bathtub) to relieve pressure. This could either be a hot tap or a cold tap.

The valve 44, along with the attached pipe section and fitting 60, is unthreaded from the connection 56 of the flex tubing 52. This leaves an open connection, as illustrated in FIG. 3. Some water seepage would be expected at this time, but this would have no substantial effect. Then, the copper pipe 40 is cut next to the connecting portion 48, this being accomplished either with tubing cutters or a metal saw. At this point, the cut edge of the pipe 40 should be examined, and any metal burrs should be removed if they are present.

Then the valve assembly 70 of the present invention is inserted between, and connected to, the connector 56 of the flex tubing and the pipe 40. Specifically, the connecting portion 74 is slipped over the end of the pipe section 40, and the compression nut 106 is threaded in a manner to compress the ferrule 108 and make a watertight connection by use of a pair of wrenches engaging the nut 106 and the flat surfaces at 122 on the valve 72. Then, the pair of wrenches are applied between the connecting portion 75 at the location 122 and the nut 126 of the connecting portion 56. With the valve installation complete, the main valve 22 can be moved to its open position. The installed valve assembly 70 should then be checked for leakage. If any leakage appears, either or both of the nuts 106 and 126 should be tightened to remedy the leak.

In the event that there is no existing valve which is to be replaced, then generally the same procedure is followed as indicated above, except that it is not necessary to remove the existing valve. Thus, the valve assembly 70 would be placed in connecting relationship with an open end of a pipe in the existing water supply network (or on the end of a pipe which has been specifically connected into the network for that installation), with the rest of the connection being accomplished as indicated above.

It is to be understood that within the broader scope of the present invention, even though the present invention has been described relative to a valve leading to a hot water tank, this method and valve assembly 70 of the present invention could also be applied in other similar situations where problems such as those noted above exist. Further, it is to be understood that various modifications could be made in the present invention without departing from the main teachings thereof.

We claim:

1. A method of installing a valve in a water distribution network of an existing plumbing system where there is:

(a) a distribution pipe having an upstrean end and a downstream outlet end, and also having an outside surface of a predetermined outside diameter, and an inside surface defining a passageway having a predetermined passageway diameter and passageway cross-sectional area;

(b) an existing shutoff valve located upstream of the upstream end of the distribution pipe;

said method comprising:

(a) determining an installation location where the valve is to be installed in the plumbing system;

(b) operating said existing shutoff valve to stop flow of water to said installation location;

(c) providing said distribution pipe at said installation location with an open pipe end portion which is substantially undistorted and provides a substantially uninterrupted through passageway portion, without enclosing said installation location in a watertight containment and with said installation location being open to the surrounding environment;

(d) providing a valve assembly comprising:

(1) a valve comprising:

(i) a main body portion defining a central through passageway section having a cross-sectional area at least as great as that of the pipe passageway;

(ii) a valve closure member having a first position closing said central through passageway section and a second position where said central through passageway section is substantially unobstructed;

(iii) a first connecting portion defining a substantially unobstructed through passageway portion, and having an exterior threaded surface portion with threads arranged to receive a compression fitting;

(iv) a second connecting portion defining a substantially unobstructed through passageway portion, and having an exterior threaded surface portion with threads adapted to receive a conventional plumbing connecting member with interior threads;

(2) a compression nut having an annular integral structure, with an inner threaded surface to engage the threaded surface portion of said first connecting portion, and having a through opening to receive said pipe end portion;

(3) an annular compression seal member adapted to be positioned adjacent said pipe end portion in sealing engagement with said first connecting portion and said pipe end portion;

(e) inserting said valve at said installation location, with said compression nut and said seal member being placed adjacent said pipe end portion and with said first connecting portion being in connecting relationship with said pipe end portion and threading said nut onto said first connecting portion to bring said seal member in sealing relationship with the pipe end portion;

(f) interconnecting said valve to an end use component to which water is to be delivered, by threading a conventional interiorily threaded connecting member onto said second connecting portion, with said conventional interiorly threaded member being connected to said end use component;

(g) opening said existing shutoff valve.

2. The method as recited in claim 1, wherein said first connecting portion of the valve has an interior surface configured to engage an exterior surface of said pipe end portion, and said pipe end portion is inserted into said first connecting portion of the valve.

3. The method as recited in claim 2, wherein there is an existing valve at the installation location, and said pipe end portion is provided by cutting said existing valve from said distribution pipe while said installation location is open to the surrounding environment.

4. The method as recited in claim 3, wherein said existing valve is also connected to a connecting nut of a flex tube member, and said existing valve is unthreaded from the connecting nut, said method further comprising connecting the second connecting portion of the valve to the nut of the flex tube member.

5. The method as recited in claim 1, wherein said end component comprises a water heater, a flex tube member connected to an inlet of said water heater, and an existing valve assembly comprising an existing valve having a soldered connection to an existing inlet pipe, said method further comprising unthreading said flex tube connecting member from said valve assembly, cutting said inlet pipe so as to separate the existing valve from the system, then installing said valve in place of said existing valve by connecting said first connecting portion to the pipe end portion, and then threading a connecting nut of the flex tube member onto the second connecting portion.

6. A valve assembly made according to the method of claim 1, wherein with said valve closure member in its second position, there is a substantially unrestricted flow passageway from said pipe end portion through said central through passageway of the valve.

7. The valve assembly as recited in claim 6, wherein said first connecting portion of the valve has an interior surface configured to engage an exterior surface of said pipe end portion, and said pipe end portion is inserted into said first connecting portion of the valve.

8. The valve assembly as recited in claim 7, wherein said first connecting portion of the valve has an annular shoulder to engage an edge portion of said pipe end portion and thus locate said valve relative to the pipe end portion.

9. The valve assembly as recited in c1aim 8, wherein said closure member is a gate member, with said valve being arranged so that said gate member is moved totally out of alignment with said pipe end portion in its open position.

10. The valve assembly as recited in claim 6, wherein said closure member is a gate member, with said valve being arranged so that said gate member is moved totally out of alignment with said pipe end portion in its open position.

11. A valve particularly adapted to be installed in a water distribution network of an existing plumbing system where there is a distribution pipe having an upstream end and a downstream portion, and also having an outside surface of a predetermined outside diameter, and an inside surface defining a passageway having a predetermined passageway diameter and a passageway cross-sectional area, and an existing shutoff valve located upstream of the upstream end of the distribution pipe, wherein said valve is installed by providing: means for operating said existing shutoff valve to first stop flow of water to said installation location, and then opening said existing shutoff valve after installation of said valve; means for providing said distribution pipe at said installation location with an open pipe end portion which is substantially undistorted and provides a substantially uninterrupted through passageway portion, without enclosing said installation location in a watertight containment and with said installation location being open to the surrounding environment; a compression nut having an annular integral structure, with an inner threaded surface, and having a through opening to receive said pipe end portion; an annular compression seal member adapted to be positioned adjacent said pipe end portion in sealing engagement with said compression nut; an interiorly threaded connecting member; means for inserting said valve at said installation location, with said compression nut and said seal member being placed over said pipe end portion and for threading said nut onto said first connecting portion; means for threading said interiorly threaded connecting member onto said second connecting portion with said interiorly threaded member being connected to an end use component to which water is to be delivered, said valve comprising:

a. a main body portion defining a central through passageway section having a cross-sectional area at least as great as that of the pipe passageway;

b. a valve closure member having a first position closing said central through passageway section and a second position where said central through passageway section is substantially unobstructed;

c. a first connecting portion defining a substantially unobstructed through passageway portion, and having an exterior threaded surface portion with threads arranged to receive a compression fitting;

d. a second connecting portion defining a substantially unobstructed through passageway portion, and having an exterior threaded surface portion with threads adapted to receive a conventional plumbing connecting member with interior threads;

whereby said valve can be inserted at an installation location to form a substantially unobstructed through passageway from said pipe end portion.

12. The valve as recited in claim 11, wherein said first connecting portion of the valve has an interior surface configured to engage an exterior surface of said pipe end portion.

13. The valve as recited in claim 12, wherein said first connecting portion of the valve has an annular shoulder to engage an edge portion of said pipe end portion and thus locate said valve relative to the pipe end portion.

14. The valve as recited in claim 13, wherein said closure member is a gate member, with said valve being arranged so that said gate member is moved totally out of alignment with said pipe end portion in its open position.

15. The valve as recited in claim 11, wherein said closure member is a gate member, with said valve being arranged so that said gate member is moved totally out of alignment with said pipe end portion in its open position.

16. A valve assembly particularly adapted to be installed in a water disttribution network of an existing plumbing system where there is a distribution pipe having an upstream end and a downstream outlet end, and also having an outside surface of a predetermined outside diameter, and an inside surface defining a passageway having a predetermined passageway diameter and a passageway cross-sectional area, and an existing shutoff valve located upstream of the upstream end of the distribution pipe, wherein said valve is installed by providing: means for operating said existing shutoff valve to first stop flow of water to said installation location, and then opening said existing shutoff valve after installation of said valve; means for providing said distribution pipe at said installation location with an open pipe end portion which is substantially undistorted and provides a substantially uninterrupted through passageway portion, without enclosing said installation location in a watertight containment and with said installation location being open to the surrounding environment; an interiorly threaded connecting member; means for inserting said valve at said installation location; means for threading said interiorly threaded connecting member onto said second connecting portion with said interiorly threaded member being connected to an end use component to which water is to be delivered, said valve comprising:

a. a valve assembly comprising:

1. a main body portion defining a central through passageway section having a cross-sectional area at least as great as that of the pipe passageway;
2. a valve closure member having a first position closing said central through passageway section and a second position where said central through passageway section is substantially unobstructed;
3. a first connecting portion defining a substantially unobstructed through passageway portion, and having an exterior threaded surface portion with threads arranged to receive a compression fitting;
4. a second connecting portion defining a substantially unobstructed through passageway portion, and having an exterior threaded surface portion with threads adapted to receive a conventional plumbing connecting member with interior threads;

b. a compression nut having an annular integral structure, with an inner threaded surface to engage the threaded surface portion of said first connecting portion, and having a through opening to receive said pipe end portion;

c. an annular compression seal member adapted to be positioned adjacent said pipe end portion in sealing engagement with said first connecting portion and said pipe end portion.

17. The valve assembly as recited in claim 16, wherein said first connecting portion of the valve has an interior surface configured to engage an exterior surface of said pipe end portion, and said pipe end portion is inserted into said first connecting portion of the valve.

18. The valve assembly as recited in claim 17, wherein said first connecting portion of the valve has an annular shoulder to engage an edge portion of said pipe end portion and thus locate said valve relative to the pipe end portion.

19. The valve assembly as recited in claim 18, wherein said closure member is a gate member, with said valve being arranged so that said gate member is moved totally out of alignment with said pipe end portion in its open position.

20. The valve assembly as recited in claim 16, wherein said closure member is a gate member, with said valve being arranged so that said gate member is moved totally out of alignment with said pipe end portion in its open position.

* * * * *